United States Patent [19]

Steiner et al.

[11] 4,429,812

[45] Feb. 7, 1984

[54] SOAP DISPENSING SYSTEM

[75] Inventors: Robert L. Steiner; Randel P. Smith, both of Chicago, Ill.

[73] Assignee: Steiner Corporation, Salt Lake City, Utah

[21] Appl. No.: 254,940

[22] Filed: Apr. 16, 1981

[51] Int. Cl.[3] ..... B67D 5/06

[52] U.S. Cl. ..... 222/181; 141/18

[58] Field of Search ..... 222/80, 81, 82, 83, 222/87, 89, 90, 94, 325, 519, 105, 180, 181, 207, 145; 141/18, 367; 403/356, 359, 355

[56] References Cited

U.S. PATENT DOCUMENTS

| | | | |
|---|---|---|---|
| 1,735,465 | 11/1929 | Kooperstein | 222/181 |
| 2,142,293 | 1/1939 | Waite | 222/90 |
| 3,266,674 | 8/1966 | Martin | 222/146 |
| 4,018,363 | 4/1977 | Cassia | 222/80 |
| 4,036,406 | 7/1977 | Jespersen et al. | 222/181 |
| 4,149,573 | 4/1979 | Cassia | 141/18 |
| 4,173,858 | 11/1979 | Cassia | 141/18 |

FOREIGN PATENT DOCUMENTS

| | | | |
|---|---|---|---|
| 409670 | 10/1966 | Switzerland | 222/90 |
| 700200 | 11/1953 | United Kingdom | 222/181 |

*Primary Examiner*—Joseph J. Rolla
*Assistant Examiner*—Kenneth Noland
*Attorney, Agent, or Firm*—Emrich & Lee and Brown, Hill, Dithmar, Stotland, Stratman & Levy

[57] ABSTRACT

A liquid soap dispensing system includes a closed soap container having a manually actuated dispensing pump carried therebeneath, the container being separated by a partition into a lower soap reservoir and an upper refill compartment, the latter adapted to enclose therein a removable refill cartridge and having a downwardly extending refill well with a pair of opposed keys extending thereinto. The cartridge has an outlet neck, the outer surface of which has a pair of opposed slots. The neck is closed by a pierceable membrane recessed therein and adapted to be received into the well so that a cartridge opening member pierces the membrane to accommodate free flow of liquid soap from the cartridge to the reservoir. The cartridge is entirely closed to define the liquid level in the reservoir at the bottom of the neck, and a drain hole in the reservoir wall above the bottom of the neck but below the tops of the keys prevents bootleg cartridges from being used in the soap dispenser. A slot in the wall of the refill compartment prevents the accumulation of free liquid soap therein.

26 Claims, 9 Drawing Figures

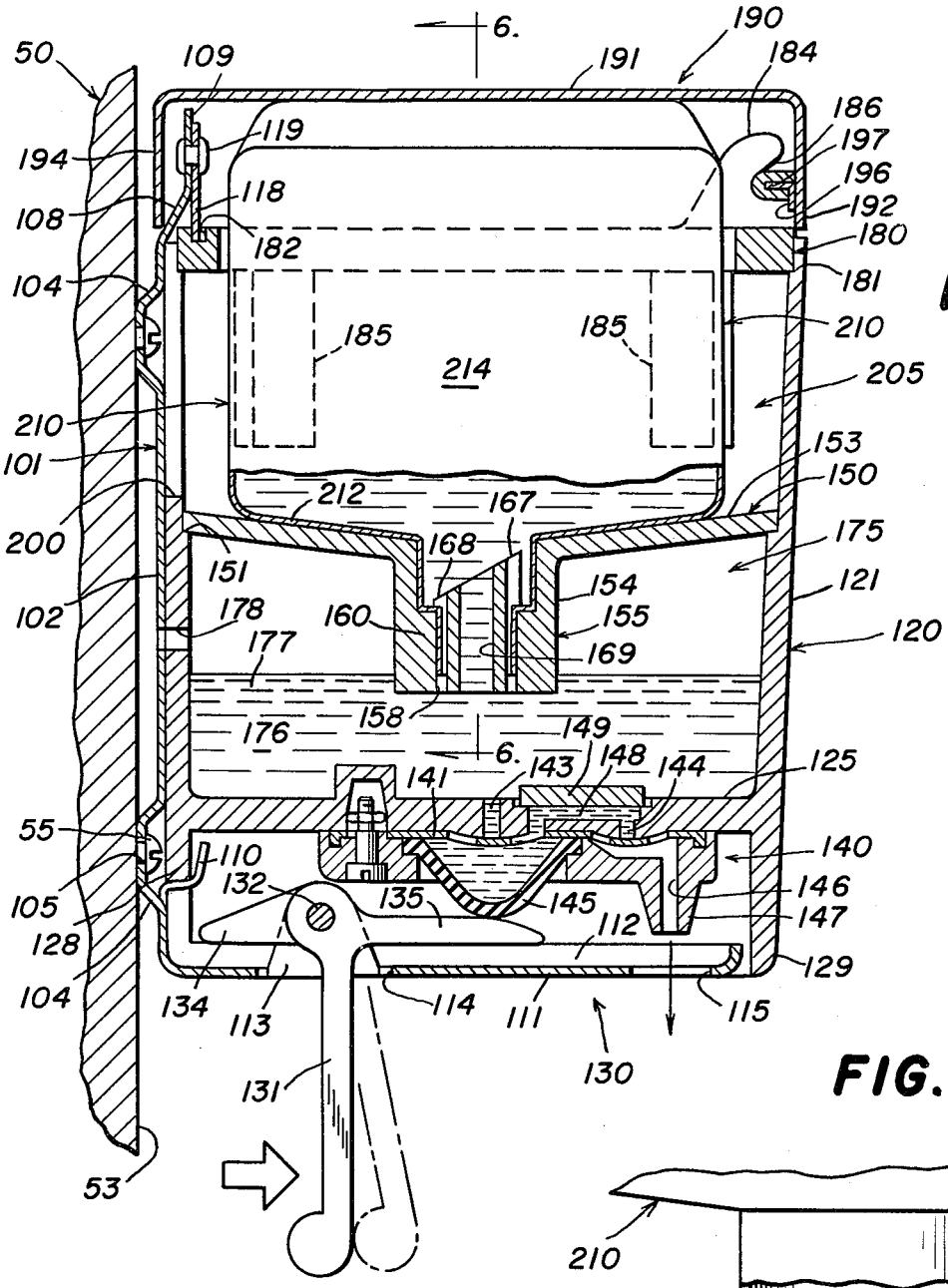
FIG. 3
FIG. 4
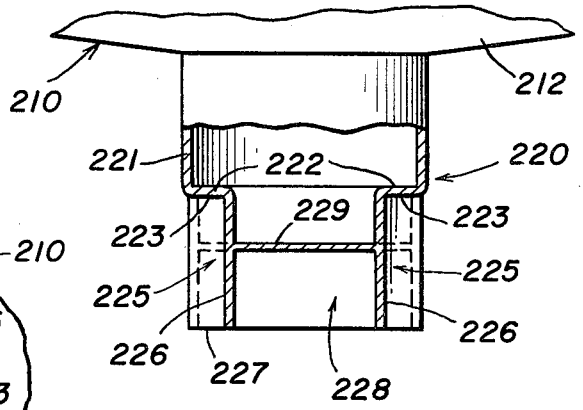
FIG. 5
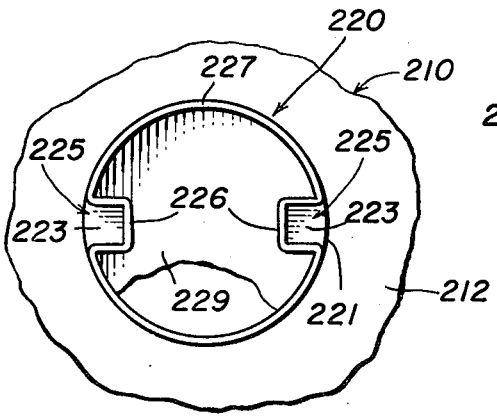

SOAP DISPENSING SYSTEM

BACKGROUND OF THE INVENTION

The present invention relates to apparatus for dispensing liquid soap, normally in discrete small quantities or charges. Such dispensing apparatus is used, particularly for hygienic purposes, in public or institutional washrooms or the like or wherever there are a relatively large number of different users.

The present invention is an improvement on the soap dispensers and refill systems therefor disclosed and claimed in U.S. Pat. No. 4,018,363 granted Apr. 19, 1977 to Antonio Macchi Cassia, U.S. Pat. No. 4,149,573 granted Apr. 17, 1979 to Antonio Macchi Cassia, and U.S. Pat. No. 4,173,858 granted Nov. 13, 1979 to Antonio Macchi Cassia. While all of these systems and dispensers work effectively, they are all to some extent subject to having the refill cartridges designed for use therewith bootlegged by third parties. That is, although the dispenser is designed to accept a specific cartridge, third parties often attempt to enter the replaceable cartridge market and bootleg inferior soap products into the dispenser.

It is this particular bootleg problem to which the present invention is directed and which is solved in a unique manner.

SUMMARY OF THE INVENTION

Therefore, it is a general object of this invention to provide a liquid soap dispensing system, which includes a refillable dispenser, and which avoids the disadvantages of prior art dispensing systems while affording additional structural and operating advantages.

It is another object of this invention to provide a soap dispensing system of the type set forth which accommodates free flow of liquid soap from the refill cartridge through the refill aperture into the soap reservoir of the container while preventing the introduction of liquid soap into the upper refill compartment and the use of refill cartridges without a specific neck design.

Another object of this invention is the provision of a liquid soap dispensing system which includes a refillable liquid soap container having a refill compartment therein in which a refill cartridge may be enclosed and left in place and feeds the reservoir in response to the dispensing operation.

Yet another object of this invention is the provision of a liquid soap dispensing system of the type set forth which is adapted only for use with a specially designed refill cartridge.

In connection with the foregoing objects, it is another object of this invention to provide a liquid soap dispensing system of the type set forth, which includes mechanism carried by both the container and the cartridge for maintaining the cartridge in a predetermined refill configuration.

It is another object of this invention to provide a refillable liquid soap dispenser for use in a system of the type set forth.

Yet another object of this invention is the provision of a refill cartridge uniquely designed for use with a system of the type set forth.

These and other objects of the invention are achieved in a system for dispensing liquid soap comprising a closed wall structure defining a container, partition means separating the container into a lower liquid soap reservoir and an upper refill compartment, dispensing means carried by the container for dispensing liquid soap from the reservoir, a refill aperture in the partition means providing communication between the reservoir and the refill compartment, a refill cartridge containing liquid soap and having an outlet, and mechanism carried by the refill cartridge and the container for maintaining the cartridge in a predetermined refill configuration and in communication with the refill aperture, the refill cartridge being removably enclosed within the refill compartment in a refill configuration with the outlet disposed for cooperation with the refill aperture to permit flow of liquid soap from the refill cartridge to the reservoir thereby to refill the reservoir.

Yet another object of the invention is to provide a system for dispensing liquid soap comprising a closed wall structure defining a container, partition means separating the container into a lower liquid soap reservoir and an upper refill compartment, dispensing means carried by the container for dispensing liquid soap from the reservoir, a refill well extending downwardly from the partition means having a refill aperture therein providing communication between the reservoir and the refill compartment, and a refill cartridge containing liquid soap and having an outwardly extending neck defining an outlet, one of the refill well and the refill cartridge having a key extending therefrom and the other having a slot therein shaped to receive the key, the refill cartridge being removably enclosed within the refill compartment in a refill configuration with the neck disposed for cooperation with the refill well and with the key in the slot to permit flow of liquid soap from the refill cartridge to the reservoir thereby to refill the reservoir, the refill cartridge being removably enclosed within the refill compartment in a refill configuration with the key in the slot to permit flow of liquid soap from the refill cartridge to the reservoir thereby to refill the reservoir.

A further object of the invention is to provide a system for dispensing liquid soap comprising a closed wall structure defining a container, partition means separating the container into a lower liquid soap reservoir and an upper refill compartment, dispensing means carried by the container for dispensing liquid soap from the reservoir, a refill well extending downwardly from the partition means having a refill aperture therein providing communication between the reservoir and the refill compartment, the inner surface of the refill well having a key extending therefrom and longitudinally of the refill well, and a refill cartridge containing liquid soap and having an outwardly extending neck defining a tubular outlet the outer surface thereof forming a slot shaped to receive the key.

A still further object of the invention is to provide a system for dispensing liquid soap comprising a closed wall structure defining a container, partition means separating the container into a lower liquid soap reservoir and an upper refill compartment, dispensing means carried by the container for dispensing liquid soap from the reservoir, a refill well extending downwardly from the partition means having a portion of the inner surface thereof forming a key and having a refill aperture therein providing communication between the reservoir and the refill compartment, an upwardly extending cartridge opening member in the refill well having the outer peripheral surface thereof spaced from the inner surface of the well and the key formed thereby, and a refill cartridge containing liquid soap and having an outwardly extending neck with the outer surface thereof having a slot therein shaped complementary to the key and defining an outlet having a closure member therein, the refill cartridge being removably enclosed within the refill compartment in a refill configuration with the neck disposed in the space between the cartridge opening member and the inner surface of the refill well with the key in the slot and the closure member opened by contact with the cartridge opening member to permit flow of liquid soap from the refill cartridge to the reservoir thereby to refill the reservoir.

Yet another object of the invention is to provide a liquid soap dispenser comprising a closed wall structure defining a container, partition means separating the container into a lower liquid soap reservoir and an upper refill compartment, dispensing means carried by the container for dispensing liquid soap from the reservoir, and a refill well extending downwardly from the partition means having a portion of the inner surface thereof forming a key and having a refill aperture therein providing communication between the reservoir and the refill compartment.

Still another object of the invention is to provide a liquid soap dispenser comprising a closed wall structure defining a container, partition means separating the container into a lower liquid soap reservoir and an upper refill compartment, dispensing means carried by the container for dispensing liquid soap from the reservoir, a refill well extending downwardly from the partition means having a portion of the inner surface thereof forming a key and having a refill aperture therein providing communication between the reservoir and the refill compartment, and an upwardly extending cartridge opening member in the refill well having the outer peripheral surface thereof complementary to and spaced from the inner surface of the well and the key formed thereby.

Still a further object of the invention is to provide a refill cartridge comprising a vessel in the shape of a polyhedron having parallel top and bottom walls and a plurality of planar side walls substantially normal to the top and bottom walls, and a neck extending outwardly from the bottom wall with the outer surface of the neck having a slot therein.

A final object of the invention is to provide a refill cartridge comprising a semirigid vessel generally in the shape of a polyhedron having parallel top and bottom walls and a plurality of planar side walls substantially normal to the top and bottom walls, a quantity of liquid soap in the vessel, an outlet neck extending from the bottom wall having at least one slot in the outer surface thereof, and a closure member in the neck retaining the liquid soap in the vessel.

Further features of the invention pertain to the particular arrangement of the parts of the liquid soap dispensing system whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 3 is a view in vertical section taken along the line 3—3 in FIG. 2, and illustrating the internal construction of the soap dispenser;

FIG. 4 is an enlarged fragmentary elevational view in partial vertical section of the outlet neck of the refill cartridge of the present invention;

FIG. 5 is a bottom elevational view of the refill cartridge outlet neck illustrated in FIG. 4;

DESCRIPTION OF THE PREFERRED EMBODIMENT

Figure 1:
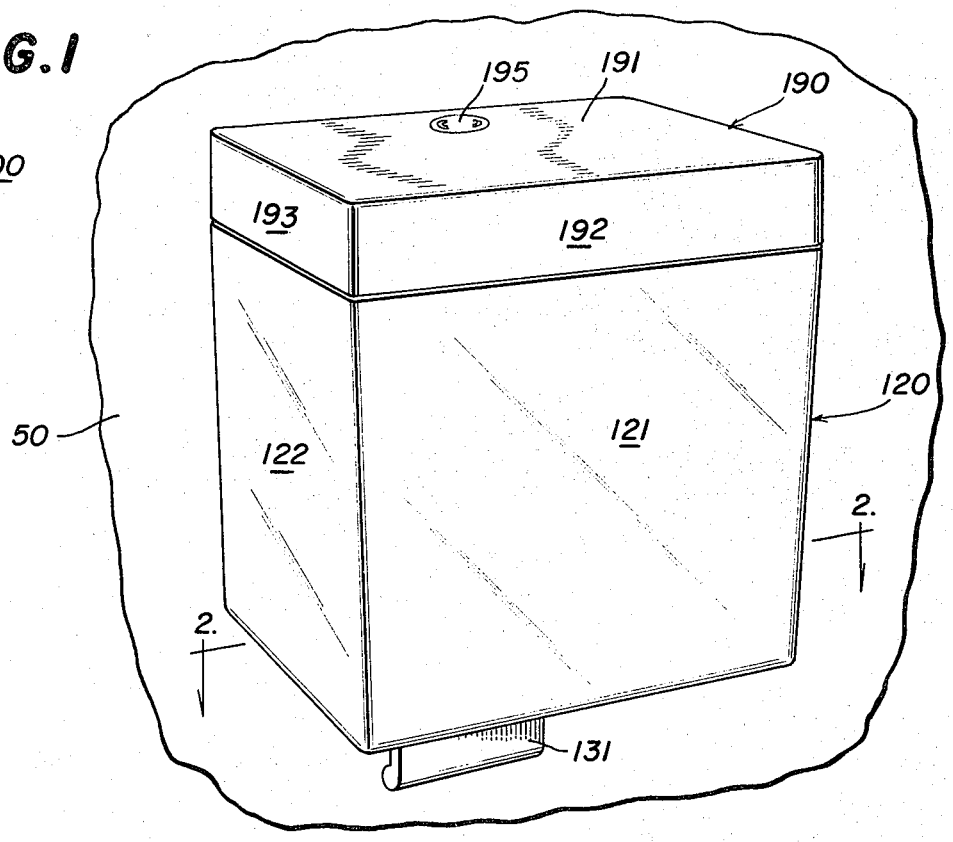
FIG. 1 is a front perspective view of a liquid soap dispenser constructed in accordance with and embodying the features of the present invention.
Figure 2:
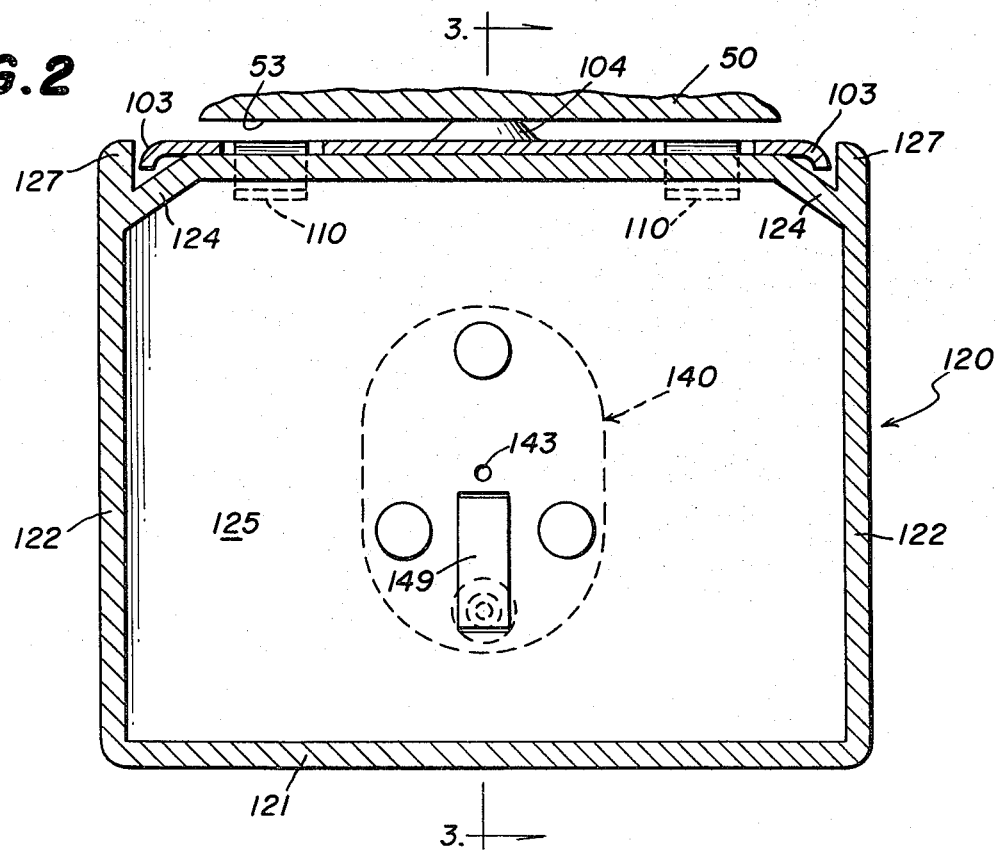
FIG. 2 is an enlarged view in horizontal section taken along the line 2—2 in FIG. 1.
Figure 6:
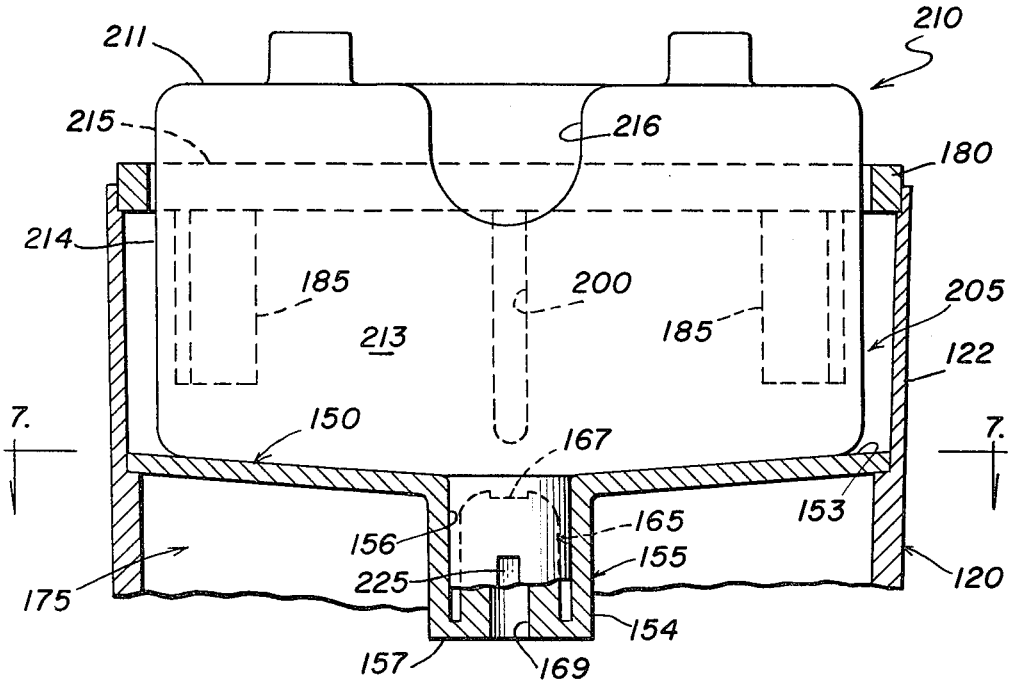
FIG. 6 is a fragmentary view in vertical section taken along the line 6—6 in FIG. 3, with the cover plate of the dispenser removed.
Figure 7:
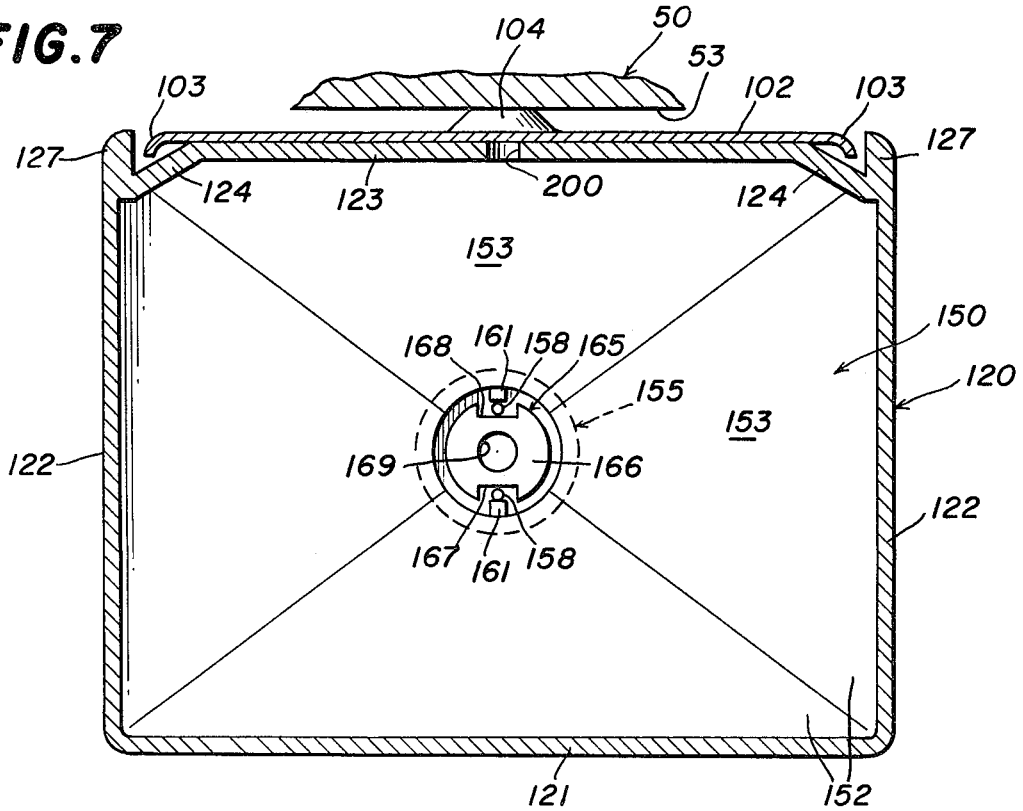
FIG. 7 is a view in horizontal section taken along the line 7—7 in FIG. 6.

Referring now to FIGS. 1 through 3 of the drawings, there is illustrated a soap dispenser 100, constructed in accordance with and embodying the features of the present invention. The soap dispenser 100 includes a mounting bracket, generally designated by the numeral 101, which includes a generally flat rectangular wall 102 disposed substantially vertically in use to provide a bearing surface, and having along each of the side edges thereof an integral curved side flange 103 which projects forwardly from the wall 102. Formed in the vertical wall 102 and projecting rearwardly therefrom in a direction away from the direction in which the side flanges 103 extend, are two substantially vertically aligned embossments 104, each having an opening 105 extending therethrough centrally thereof. Also formed in the wall 102 and projecting rearwardly therefrom are two embossments (not shown) which are disposed substantially in horizontal alignment with each other along a line disposed substantially midway between the embossments 104, with the embossments (not shown) projecting the same distance as the embossments 104, and each having an opening (not shown) extending therethrough centrally thereof.

Integral with the wall 102 at the upper end thereof is an extension flange 108 which is inclined forwardly in the same general direction as the side flange 103, and which is integral at the distal end thereof with an upwardly extending flange 109 which is substantially parallel to the wall 102. Punched from the wall 102 adjacent to the lower end thereof are two forwardly and upwardly extending support fingers 110.

Integral with the bottom end of the wall 102 and extending forwardly therefrom substantially normal thereto is a wall 111 which is disposed substantially horizontally in use and is provided around the periphery thereof with an integral upturned flange 112, which is in turn integral with the side flanges 103. Integral with the wall 111 and projecting upwardly therefrom substantially normal thereto are two parallel and laterally spaced apart pivot brackets 113, a portion of the wall 111 between the pivot brackets 113 being cut out to define a generally rectangular opening 114. Formed in the wall 111 adjacent to the forward edge thereof and substantially midway between the side edges thereof is a circular soap discharge opening 115, the purpose of the openings 114 and 115 being described more fully below. A circular retaining plate 118 is pivotally secured to the inner surface of the upwardly extending flange 109 as by a rivet 119.

In use, the mounting bracket 101 is mounted on a wall 50, generally above and closely adjacent to a sink or washbasin or the like. The mounting bracket 101 is fixedly secured to the wall 50 by means of mounting screws 55 which are passed through the openings in the embossments 104 and threadedly engaged in the wall 50, the wall 102 being disposed substantially parallel to the surface 53 of the wall 50, and being in contact therewith only at the embossments 104 and those not shown, which serve to space the mounting bracket 101 a slight distance from the surface 53 of the wall 50.

The dispenser 100 also includes a soap container or housing 120, which is preferably formed of a translucent or transparent plastic, although it will be understood that any suitable material, either opaque or light-transmitting, could be used. The container 120 is generally box-like in configuration and includes a generally rectangular front wall 121, a pair of opposed side walls 122, a rear wall 123 and a rectangular bottom wall 125, the container 120 preferably being molded so that the walls 121, 122, 123 and 125 are all formed integrally with one another. The rear wall 123 is provided at the lateral side edges thereof with inturned forwardly inclined portions 124. The side walls 122 have rearwardly extending portions 127 which project rearwardly beyond the rear wall 123, whereby the rear wall 123 is recessed with respect to the side walls 122. In addition, the rear wall 123 extends downwardly below the bottom wall 125 to form a downwardly extending portion or mounting flange 128. Similarly, the front wall 121 and the side walls 122 extend downwardly wall below the bottom wall 125 and below the bottom edge of the mounting flange 128 to form a skirt 129.

Mounted below the bottom wall 125 of the container 120 is a pump assembly or dispensing means 130. The operation and construction of the pump assembly or dispensing means 130 is described in detail in U.S. Pat. No. 4,018,363, issued Apr. 19, 1977 to Antonio Macchi Cassia and assigned to the assignee of the present invention, the disclosure of which patent relating to the pump assembly or dispensing means is incorporated herein by reference. The pump assembly or dispensing means 130 includes an operating handle 131 provided with a pivot pin 132, the opposite ends of which are respectively mounted in the pivot brackets 113 on the mounting bracket 111 for pivotal movement of the operating handle 131 about the axis of the pivot pin 132, which extends substantially horizontally above the bracket wall 111 substantially parallel thereto and to the bracket wall 102. The handle 131 projects in use downwardly through the opening 114 in the bracket wall 111 and terminates at the lower end thereof in an enlarged gripping portion. The handle 131 also includes a stop member 134 which projects rearwardly from the pin 132 above the housing wall 111, and an actuating arm 135 which projects forwardly from the pin 132 above the bracket wall 111 and is substantially longer than the stop member 134.

The pump assembly or dispensing means 130 also includes a unitary pump housing 140, which is preferably of molded construction. The pump housing 140 is fixedly secured to the bottom wall 125 of the container 120 by suitable fasteners. Securely sandwiched between the pump housing 140 and the bottom wall 124 of the container 120 is a flexible diaphragm 141 having a plurality of suction apertures therethrough in surrounding relationship with a suction conduit or opening 143 in the bottom wall 135 of the container 120. The diaphragm 141 also has a plurality of discharge apertures therein disposed in surrounding relationship with a discharge conduit 144 in the bottom wall 125, the suction conduit and the discharge conduit being joined by a passageway 148 normally covered in use by insert 149. A flexible resilient bowl 145 is disposed below the diaphragm 141 in the region of the suction conduit 143, the outer surface of the bowl 145 normally just touching the actuating arm 135 when the handle 131 is in its normal rest position illustrated in full line in FIG. 3. Disposed below the diaphragm 141 in the region of the discharge conduit 144 is a delivery conduit 146 in a spout 147 disposed immediately above and in alignment with the soap discharge opening 115 in the mounting bracket wall 111.

In operation, the soap container 120 is mounted on the mounting bracket 101 in a manner which is fully explained in the aforementioned U.S. Pat. No. 4,149,573, the disclosure of which relating to the mounting bracket is incorporated herein by reference. The operating handle 131 is pulled forwardly by a user thereby to compress the bowl 145 with the actuating arm 135 and expel a predetermined quantity of liquid soap from the delivery conduit 146, release of the operating handle 131 permitting re-expansion of the bowl 145 thereby to suck a fresh charge of liquid soap from the container 120 through the suction conduit 143 in preparation for the next dispensing operation, all as is more fully explained in the aforementioned U.S. Pat. No. 4,018,363 and 4,149,573.

The soap container 120 has a partition 150 which is disposed generally horizontally in use, the partition 150 being substantially rectangular in shape with the peripheral edges thereof resting upon a ledge 151 formed in the inner surfaces of the soap container walls 121–123 and fixedly secured thereto as by ultrasonic welding. The partition 150 comprises four generally triangular sectors 152, the upper surfaces 153 of which slope gently downwardly toward the center of the partition 150 at which there is formed a well, generally designated by the numeral 155. The well 155 includes a cylindrical side wall 154 integral at the upper end thereof with the partition 150 and extending downwardly therebelow. The well 155 has an inner surface 156 with the lower end thereof being terminated by a circular bottom wall 157. Formed in the bottom wall 157 adjacent to the outer edge thereof are diametrically opposed drain apertures 158. Extending inwardly from the inner surface 156 of the well 155 are two keys 160, the keys 160 being diametrically opposed and in general alignment with the drain apertures 158. Each of the keys 160 is generally rectangular and has a top surface 161 which terminates well below the top of the well 155 and a longitudinally extending inner end surface 162 with opposed parallel side surfaces 163. The inner end surfaces 162 may either be flat or arcuate depending on the arcuate extent of the keys 160, the exact dimensions of which are not of substantial significance.

Figure 8:
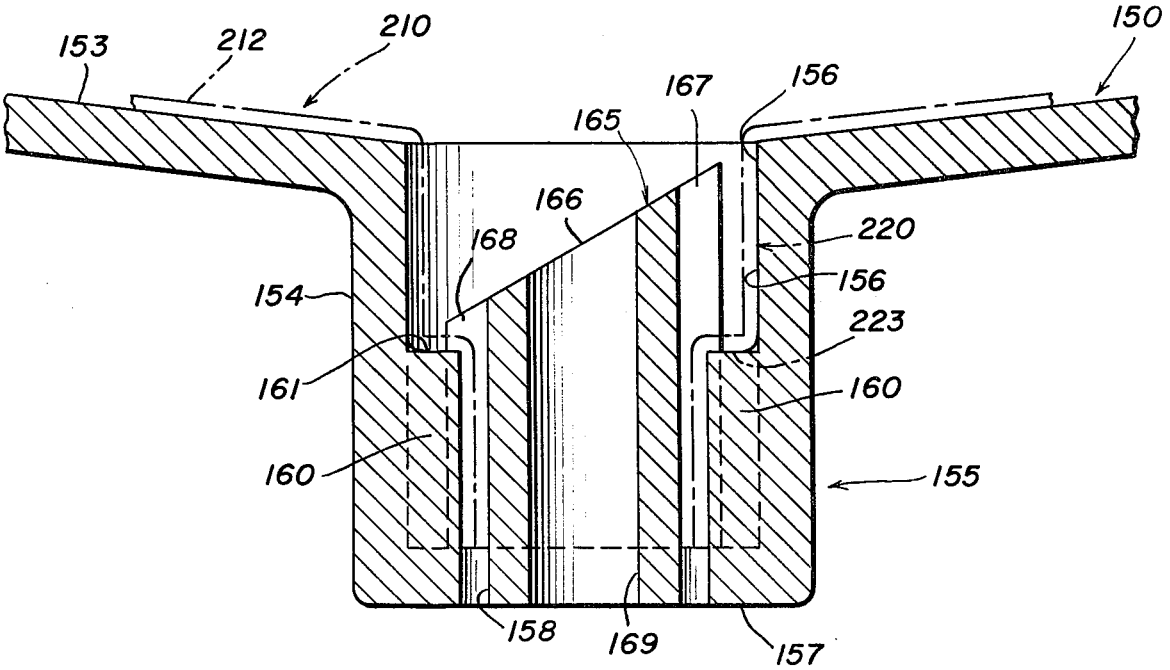
FIG. 8 is an enlarged view in vertical section of the refill well and cartridge opening member illustrated in FIG. 3.
Figure 9:
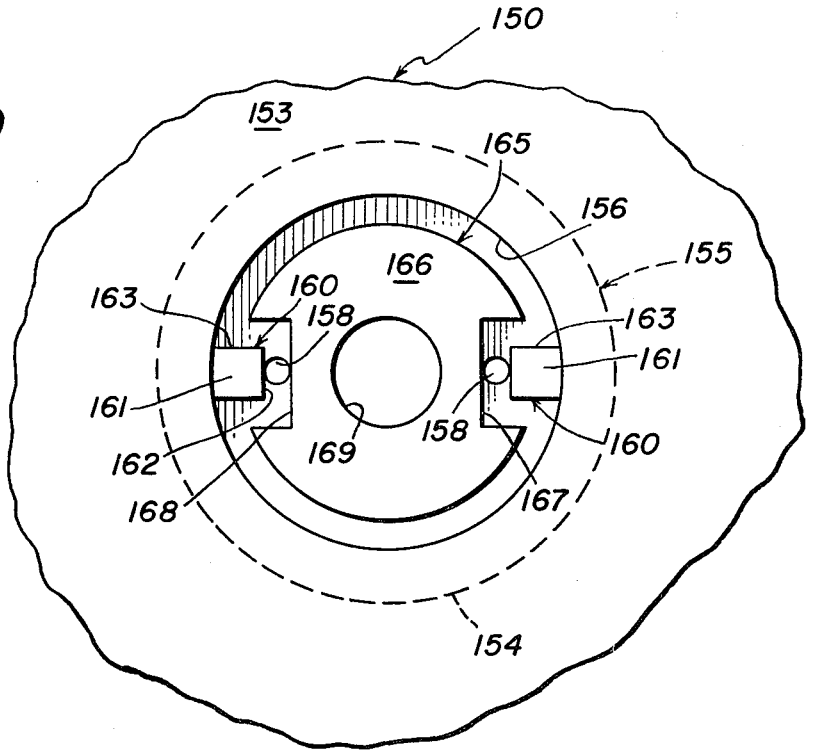
FIG. 9 is a top plan view of the refill well and cartridge opening member illustrated in FIG. 7.

Integral with the bottom wall 157 of the well 155 and extending upwardly therefrom centrally thereof and coaxially with the cylindrical side wall 154 is a hollow cartridge opening member 165 which is generally cylindrical in shape having a top surface slanting upwardly toward the front wall 121 of the soap container housing 120, the peripheral edge of the member 165 being sufficiently sharp to pierce a membrane, and a central aperture 169. The outer surface of the cartridge opening member 165 has two longitudinally extending grooves 167,168 diametrically opposed each in registry with a respective one of the keys 160, the grooves 167,168 being oversized with respect to the keys 160, see FIG. 9, and extending downwardly from the top surface 166, see FIG. 8.

It can be seen that the partition 150 cooperates with the bottom wall 125 and the walls 121–123 of the container 120 to define therebetween a liquid soap reservoir, generally designated by the numeral 175, which is adapted to be filled with a quantity of liquid soap 176 to a level 177, the position of the partition 150 in the soap container 120 being such that the reservoir 175 occupies slightly less than half the interior volume of the container 120. The container 120 and more particularly the rear wall 123 thereof has a drain opening 178 therein vertically spaced above the bottom 157 of the refill well 155 and below the top of the keys 160, which vertical position is critical to the operation of the invention, as will be explained.

The container 120 is also provided with a top plate, generally designated by the numeral 180, the outer perimeter of which conforms to the perimeter of the upper edge of the container 120 and is adapted to be seated on a ledge 181 formed in the inner surfaces of the container walls 121–123 and fixedly secured thereto as by ultrasonic welding. The top plate 180 has a large octagonal opening formed therein so that the top plate 180 essentially comprises a relatively narrow flange projecting horizontally inwardly from the walls of the container 120. Formed in the upper surface of the top plate 180 adjacent to the rear edge thereof is a shallow recess 182 adapted to receive therein the retaining plate 118 fixedly to hold the container 120 in place on the mounting bracket 101. Extending upwardly from the top plate 180 at the rear corners thereof are two rear abutments (not shown) while two forward abutments 184 respectively extend upwardly from the top plate 180 adjacent to the front corners thereof, the forward abutments 184 each having a notch 186 formed in the front surface thereof. Integral with the top plate 180 respectively adjacent to at least some of the corner edges and extending downwardly therefrom are positioning members 185 for a purpose to be explained.

The container 120 is also provided with a cover plate 190 which includes a flat rectangular top wall 191, a front wall 192, a pair of opposed side walls 193 and a rear wall 194, all integrally connected in a unitary structure. Fixedly secured to the top wall 191 adjacent to the rear edge thereof is a key-operated latch mechanism 195. Fixedly secured to the inner surface of the front wall 192 is an elongated bearing plate 196 provided at the opposite ends thereof with rearwardly extending fingers 197, each preferably covered with a resilient cushioning material, the fingers 197 being respectively adapted to be received in the notches 186 in the forward abutments 184 of the top plate 180. The cover plate 190 is dimensioned so as completely to cover the top wall 180 of the container 120, with the walls 192–194 having a vertical extent sufficient to accommodate the inclined flange 108 and the upwardly extending flange 109 of the mounting bracket 101. In use, the fingers 197 are inserted into the notches 186 of the forward abutments 184, and the cover plate 190 is then pivoted down into position completely covering the top of the container 120, as illustrated in FIG. 3, a latch hook of the latch mechanism 195 engaging in a complementary keeper opening (not shown) in the upwardly extending flange 109 of the mounting bracket 101.

Formed in the rear wall 123 of the container 120 is a vertical slot 200 which extends from just above the partition 150 to the top wall 180, for a purpose to be explained more fully below. It can be seen that the cover plate 190 cooperates with the partition 150 and the walls 121–123 of the container 120 to define a closed refill compartment, generally designated by the numeral 205, communication between the refill compartment 205 and the liquid soap reservoir 175 being provided by the refill aperture 169.

The soap dispensing system of the present invention also includes a refill cartridge 210 which is semirigid and preferably formed of a translucent soft plastic material, and is adapted to hold a supply of liquid soap for refilling the liquid soap reservoir 175 of the container 120. The refill cartridge 210 is generally in the shape of a polyhedron having top and bottom walls 211 and 212 interconnected by a pair of opposed side walls 213 and a pair of opposed end walls 214, the side walls 213 and the end walls 214 being generally perpendicular to each other and to the top and bottom walls 211 and 212. Connecting the side walls 213 to the end walls 214 and inclined substantially at 45° angles to each are four guide or corner walls 215, each of which is also perpendicular to the top and bottom walls 211 and 212. Formed at the junctions of the top wall 211 with the side walls 213 intermediate the ends thereof are two indentations or recesses 216 for receiving the fingers of a user.

Integral with the bottom wall 212 and projecting outwardly therefrom centrally thereof is a cylindrical neck 220 being coupled at the upper end thereof to the bottom wall 212. The neck 220 is in the form of a tube 221 having opposed inwardly extending slots or grooves 225 each having a top wall 222 and a bottom or rest surface 223 thereof. The slots 225 are diametrically opposed and have longitudinally extending walls 226, the inner surfaces of which define keys extending into the passageway 228 of the neck 220 and the outer surfaces of which are in registry with the surfaces 162 of the keys 160. The neck 220 has a bottom end 227 which is closed or sealed by means of a closure member 229 recessed into the passageway 228 from the bottom 227, which closure member may be a pierceable membrane.

When it is desired to refill the liquid soap reservoir 175 of the container 120, the cover plate 190 is unlocked and removed and a new refill cartridge 200 is inserted into the refill compartment 205. The refill cartridge 210 is shaped and dimensioned to just fit within the octagonal opening defined by the top plate 180, with the guide walls 215 of the refill cartridge 210 being respectively disposed for sliding engagement with positioning members 185 which cooperate to guide the neck 220 of the refill cartridge 210 into the well 155. The neck 220 and particularly the tubular wall portion 221 thereof along with the slots 225 there are dimensioned to fit within the well 155 and more particularly to fit in the annular space between the upstanding cartridge opening member 165 and the inner surface 156 of the well. More specifically, the slots 225 in the neck 220 are positioned in registry with the keys 160 extending inwardly from the inner surface 156 of the well 155 with the longitudinally extending surface 226 of each slot 225 being opposite to the adjacent longitudinally extending surface 162 of the respective key 160. As the refill cartridge 210 is moved downwardly, the upper surface 166 of the cartridge opening member 165 and more particularly the upper end thereof where the slot 167 meets the surface 166 contacts the closure member 229 in the neck 220 and pierces same. Continued downward movement of the refill cartridge 210 causes the neck 220 to seat in the well 155. As seen particularly in FIG. 5, the inner surface of the grooves or slots 225 act as keys with respect to the slots 167,168 in the upstanding cartridge opening member 165 thereby to slidably fit the cartridge 210 within the well 155.

Because the cartridge 210 is closed, that is imperforate except at the neck 220, the liquid soap 176 in the cartridge 210 feeds into the reservoir 175 only to the level of the effective outlet of the cartridge 210 which is the bottom or end surface 227 of the cartridge neck 220, thereby to maintain the liquid level 177 in the reservoir at that fixed position, until the supply of soap 176 in the cartridge 210 is exhausted, which is always below the drain hole 178 in the rear wall 123 of the soap container housing 120.

Accordingly, it is now clear how the the anti-bootleg feature of the invention is accomplished. By means of the keys 160 extending inwardly from the inner surface 156 of the well 155 and the peculiar complementary shape of the upstanding cartridge opening member 165, the cartridge 210 must have the neck 220 thereof specifically designed to seat all the way to the bottom of the well 155, as disclosed. In the event a bootlegger attempts to use a standard cylindrical neck cartridge in the soap dispenser 100, the keys 160 will prevent the neck from extending down to the liquid level 177 shown in FIG. 3. The bootlegged cartridge will only seal to the top 161 of the keys 160, whereby the liquid level in the reservoir 175 will rise to that level which is specifically designed to be above the drain hole 178 thereby causing soap to run out of the reservoir and the dispenser 100. Only cartridges 210 having the specific key accommodating slots 225 therein will fully seat in the well 155 thereby to permit liquid soap 176 contained in the cartridge to drain through the central aperture 169 into the reservoir 175 to a level 177 below the drain hole 178.

When the refill cartridge 210 has thus been inserted to its refill configuration in the refill compartment 205, that is with the neck 220 fully seated into the well 155, thereby to establish the liquid level 177 as illustrated in FIG. 3 of the drawings, the cover plate 190 is then locked in place to close the refill compartment 205 and the enclosed refill cartridge 210 therein. It will be appreciated that the entire cartridge replacement operation can be performed in a matter of seconds.

When the next service call is made, the serviceman can immediately tell from inspection of the translucent refill cartridge 210 whether or not it is empty. If it is empty, it is removed and discarded and a new refill cartridge 210 is inserted into its place in the manner described above. If the refill cartridge 210 is not empty, then the serviceman knows that the reservoir 175 still has a substantial quantity of soap 176 therein and that no further refill is needed.

It is an important feature of the invention that the soap dispenser 100 is usable only with the refill cartridge 210 specifically designed therefor, so that the container 120 cannot be refilled with liquid soap from an unauthorized source. This purpose is furthered by the slot 200 in the rear wall 123 of the container 120. More particularly, it will be understood that by reason of the dimensions of the central aperture 169 which permit free flow of liquid soap therethrough by gravity under ambient pressure, there would be a temptation for unauthorized purveyors of liquid soap to simply pour free or bulk liquid soap into the refill compartment 205 and let it drain through the refill aperture 169. If this is attempted, however, the soap will immediately also flow out through the slot 200, running down the back of the container 100, onto the bracket wall 111 and along the outside of the pump assembly 130 creating a messy overflow and possibly fouling the dispensing mechanism. Thus, it will be appreciated that the slot 200 effectively prevents the accumulation of free liquid soap in the reservoir 175.

The above anti-bootleg feature of the slot 200 in combination with the cooperating design of the refill well 155, the upstanding cartridge opening member 165 and the cartridge neck 220 fully prevents the use of unauthorized soap refill cartridges 210 in the dispenser 100 of the present invention. Since bootlegging refill cartridges is the single most import economic factor in the liquid soap dispensing business, this invention has attained its principal objects by the aforementioned combination of features.

It will be noted that the finger recesses 216 in the refill cartridge 210 serve to facilitate handling thereof during insertion into and removal from the refill compartment 205. These recesses are particularly useful in removal of the spent refill cartridge 210 because of the very close fit between the walls of the cartridge 210 and the top plate 180 and because, when fully inserted into its refill configuration, the refill cartridge 210 only extends a slight distance above the top plate 180.

In storage of the refill cartridge 210 it is generally preferable to dispose the top wall 211 downward, since this affords a more stable base than does the neck 220. It will be appreciated that the upstanding ribs provide bearing surfaces for supporting the refill cartridge 210 thereon during storage.

From the foregoing, it can be seen that there has been provided an improved soap dispensing system, a refillable liquid soap dispenser and a refill cartridge therefor, such that there is permitted rapid servicing of the dispenser for refill therefor, while at the same time effectively preventing refilling of the container with soap from an unauthorized source.

While there has been provided what at present is considered to be the preferred embodiment of the soap dispensing system, the soap dispenser, and the refill cartridge, it will be understood that various modifications and alterations may be made therein without departing from the broadest scope of the present invention which is intended to be covered in the claims appended hereto.

What is claimed is:

1. A system for dispensing liquid soap comprising a closed wall structure defining a container, partition means separating said container into a lower liquid soap reservoir and an upper refill compartment, dispensing means carried by said container for dispensing liquid soap from said reservoir, a refill aperture in said partition means providing communication between said reservoir and said refill compartment, a refill cartridge containing liquid soap and having an outlet and being imperforate except at the outlet thereof, and slot and key mechanism carried by said refill cartridge and said container for maintaining said cartridge in a predetermined refill configuration and in communication with said refill aperture, a drain slot in said upper refill compartment to cause bulk liquid soap poured thereinto to flow therefrom, and a drain opening in said lower liquid soap reservoir vertically spaced above the cartridge outlet when said cartridge is in the refill configuration thereof, said refill cartridge being removably enclosed within said refill compartment in a refill configuration with said outlet disposed for cooperation with said refill aperture to permit flow of liquid soap from said refill cartridge to said reservoir thereby to refill said reservoir.

2. A system for dispensing liquid soap comprising a closed wall structure defining a container, partition means separating said container into a lower liquid soap reservoir and an upper refill compartment, dispensing means carried by said container for dispensing liquid soap from said reservoir, a refill well extending downwardly from said partition means having a refill aperture therein providing communication between said reservoir and said refill compartment, an upwardly extending cartridge opening member in said refill well having the outer peripheral surface thereof spaced from the inner surface of said well and a refill cartridge containing liquid soap and having an outwardly extending neck defining an outlet, one of either said cartridge opening member or said refill cartridge having a key extending therefrom and the other one of either said cartridge opening member or said refill cartridge having a slot therein shaped to receive said key, said refill cartridge being removably enclosed within said refill compartment in a refill configuration with said neck disposed for cooperation with said refill well and said cartridge opening member and with said key in said slot to permit flow of liquid soap from said refill cartridge to said reservoir thereby to refill said reservoir.

3. The system of claim 2, wherein said refill well has the refill aperture in the bottom thereof and said refill cartridge being imperforate except at the outlet thereof.

4. The system of claim 2, wherein said key extends from the inner surface of said refill cartridge.

5. The system of claim 4, wherein the outer surface of said cartridge opening member has a slot therein shaped to receive the said key.

6. The system of claim 2, wherein one of either said cartridge opening member or said refill cartridge has an even number of keys and the other one of either said cartridge opening member or said refill cartridge has an even number of slots.

7. The system of claim 6, wherein said even number of keys extends from the inner surface of said refill cartridge neck and said even number of slots are on the outer surface of said cartridge opening member.

8. The system of claim 2, and further comprising a drain slot in said upper refill compartment to cause bulk liquid soap poured thereinto to flow therefrom, and a drain opening in said lower liquid soap reservoir vertically located between the refill aperture in said refill well and said partition means.

9. A system for dispensing liquid soap comprising a closed wall structure defining a container, partition means separating said container into a lower liquid soap reservoir and an upper refill compartment, dispensing means carried by said container for dispensing liquid soap from said reservoir, a refill well extending downwardly from said partition means having a refill aperture therein providing communication between said reservoir and said refill compartment, an annular seat in said refill well spaced from said partition, the inner surface of said refill well below said annular seat having a key extending therefrom and longitudinally of said refill well, and a refill cartridge containing liquid soap and having an outwardly extending neck defining a tubular outlet with the outer surface thereof forming an annular shoulder shaped complementary to said annular seat and a slot shaped to receive said key, said refill compartment being removably enclosed within said refill compartment in a refill configuration with said key in said slot to permit flow of liquid soap from said refill cartridge to said reservoir thereby to refill said reservoir.

10. The system of claim 9, wherein said longitudinally extending key terminates near the bottom of said refill well.

11. The system of claim 10, wherein there are an even number of keys.

12. The system of claim 10, wherein there are two diametrically opposed keys.

13. A system for dispensing liquid soap comprising a closed wall structure defining a container, partition means separating said container into a lower liquid soap reservoir and an upper refill compartment, dispensing means carried by said container for dispensing liquid soap from said reservoir, a refill well extending downwardly from said partition means having a portion of the inner surface thereof forming a key and having a refill aperture therein providing communication between said reservoir and said refill compartment, an upwardly extending cartridge opening member in said refill well having the outer peripheral surface thereof having a longitudinally extending groove therein from the top edge thereof extending downwardly in the outer surface thereof, said outer peripheral surface of said cartridge opening member and said groove formed therein being spaced from the inner surface of said well and said key formed thereby, and a refill cartridge containing liquid soap and having an outwardly extending neck with the inner surface thereof having a key shaped complementary to said groove in said cartridge opening member and with the outer surface thereof having a slot therein shaped complementary to said key on said refill well and defining an outlet having a closure member therein, said refill cartridge being removably enclosed within said refill compartment in a refill configuration with said neck disposed in the space between said cartridge opening member and the inner surface of said refill well with said keys respectively in said groove and in said slot and said closure member opened by contact with said cartridge opening member to permit flow of liquid soap from said refill cartridge to said reservoir thereby to refill said reservoir.

14. The system of claim 13, wherein there are a plurality of keys extending from said refill well and a like plurality of grooves on the outer surface of said cartridge opening member, each of said slots being in alignment with a respective one of said keys.

15. The system of claim 14, and further comprising apertures between the groove in the outer surface of said cartridge opening member and the inner surface of the downwardly extending portion of said refill well.

16. The system of claim 13, wherein said cartridge opening member is a piercing member and said closure member is a pierceable membrane.

17. The system of claim 13, wherein said cartridge opening member is a hollow right circular cylinder having opposed grooves in the outer surfaces thereof extending the entire length thereof.

18. The system of claim 13, wherein said cartridge opening member has the upper surface thereof inclined and said groove in the outer longitudinally extending surface thereof extends longitudinally from the top of said cartridge opening member.

19. The system of claim 13, wherein said cartridge neck has a portion of the outer surface thereof forming said slot and the inner surface thereof opposite said slot forming said key.

20. The system of claim 19, wherein said neck has two diametrically opposed slots in the outer surface thereof and two diametrically opposed keys extending inwardly from the inner surface thereof, said refill well having two keys each in registry with a respective one of the slots in the outer surface of said neck, said cartridge opening member having two grooves therein each in registry with a respective one of said keys on the inner surface of said neck.

21. A liquid soap dispenser comprising a closed wall structure defining a container, partition means separating said container into a lower liquid soap reservoir and an upper refill compartment, dispensing means carried by said container for dispensing liquid soap from said reservoir, a refill well extending downwardly from said partition means having a portion of the inner surface thereof forming a key and having a refill aperture therein providing communication between said reservoir and said refill compartment, a drain slot in said upper refill compartment to cause bulk liquid soap poured thereinto to flow therefrom, and a drain opening in said lower liquid soap reservoir vertically located between the refill aperture in said refill well and said partition means.

22. The dispenser of claim 21, wherein a plurality of keys extend from the inner surface of said refill well.

23. The dispenser of claim 22, wherein said keys are diametrically opposed.

24. The dispenser of claim 22, wherein said keys have the top surface thereof below the top surface of said refill well.

25. A liquid soap dispenser comprising a closed wall structure defining a container, partition means separating said container into a lower liquid soap reservoir and an upper refill compartment, dispensing means carried by said container for dispensing liquid soap from said reservoir, a refill well extending downwardly from said partition means having a portion of the inner surface thereof forming a key and having a refill aperture therein providing communication between said reservoir and said refill compartment, an upwardly extending cartridge opening member in said refill well having a longitudinally extending groove in the outer peripheral surface thereof complementary to and spaced from the inner surface of said well and said key formed thereby, a drain slot in said upper refill compartment to cause bulk liquid soap poured thereinto to flow therefrom, and a drain opening in said lower liquid soap reservoir vertically located between the refill aperture in said refill well and said partition means.

26. The dispenser of claim 25, wherein a plurality of keys extend from the inner surface of said refill well.

* * * * *

UNITED STATES PATENT AND TRADEMARK OFFICE

CERTIFICATE OF CORRECTION

PATENT NO. : 4,429,812

DATED : February 7, 1984

INVENTOR(S) : Robert L. Steiner & Randel P. Smith

It is certified that error appears in the above-identified patent and that said Letters Patent are hereby corrected as shown below:

Column 12, line 56, "slots" should be --grooves--.

Signed and Sealed this

*Fifteenth* Day of *May 1984*

[SEAL]

*Attest:*

GERALD J. MOSSINGHOFF

*Attesting Officer*

*Commissioner of Patents and Trademarks*